US007287482B1

(12) United States Patent
Banchetto et al.

(10) Patent No.: US 7,287,482 B1
(45) Date of Patent: Oct. 30, 2007

(54) FLOTATION SAFETY DEVICE FOR VEHICLES

(76) Inventors: Geraldine Banchetto, 10320 NW. 15th St., Plantation, FL (US) 33322; Jeanne Sciacca, 10320 NW. 15th St., Plantation, FL (US) 33322

( * ) Notice: Subject to any disclaimer, the term of this patent is extended or adjusted under 35 U.S.C. 154(b) by 0 days.

(21) Appl. No.: 11/361,658

(22) Filed: Feb. 23, 2006

(51) Int. Cl.
*B63B 43/14* (2006.01)
*G08B 21/00* (2006.01)

(52) U.S. Cl. ..... 114/123; 340/623

(58) Field of Classification Search ..... 114/123
See application file for complete search history.

(56) References Cited

U.S. PATENT DOCUMENTS 4,887,541 A 12/1989 Rodemann
5,113,779 A * 5/1992 Amrein et al. ..... 440/12.63
5,682,832 A 11/1997 Millard
D409,935 S 5/1999 Speckhart
6,036,559 A 3/2000 Arnold et al.
6,070,546 A 6/2000 Downey et al.
6,526,900 B2 * 3/2003 Redman ..... 114/68
6,798,346 B2 * 9/2004 Kim ..... 340/623

* cited by examiner

*Primary Examiner*—Jesús D Sotelo

(57) ABSTRACT

An emergency flotation device includes water-proof housings that are secured to a selected portion of the vehicle such that the housings are mounted medially of the vehicle's tires. Selectively inflatable flotation bags are operably coupled and permanently conjoined to the housings. The flotation bags are deployable downwardly and outwardly wherein lateral portions of the flotation bags wrap beneath and around the tires such that a bottom half of the tires are completely encapsulated by the flotation bags. Each tire receives one flotation bag thereabout. A pneumatic mechanism is included for automatically inflating and deflating the flotation bags. The pneumatic mechanism is disposed within the housings and is spaced from the tires. A mechanism is included for sensing a water level engaged with the tires. The water level sensing mechanism is connected to the pneumatic mechanism for instructing the pneumatic mechanism to inflate and deflate the tires during emergency situations.

15 Claims, 4 Drawing Sheets

FLOTATION SAFETY DEVICE FOR VEHICLES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to flotation devices and, more particularly, to a flotation safety device for vehicles.

2. Prior Art

It is unfortunate to hear of a person or persons loosing their life because they were trapped in a sinking vehicle that has become submerged in a body of water. When a vehicle is submerged under water the external pressure exerted on the doors by the water greatly exceeds the pressure inside the vehicle, such that the occupants are unable to open the vehicle's doors and thus escape. In theory, a person can wait until the interior of the vehicle has filled with water, at which point the internal and external pressures become equal, and then attempt to open the door. However, the stress and panic associated with being trapped in a submerged car often causes a person to forget about this fact, and in their state of panic they end up drowning regardless.

Even in the very fortunate event that an individual manages to wait in the vehicle and subsequently escape once the interior and exterior pressures are equalized, the vehicle is still lost. As is well known, vehicles are not inexpensive and thus a person may find that they are unable to replace their lost or water logged automobile. It has been discovered that when flood water levels are at about one foot or greater above ground level, the average vehicle, such as a car or a pickup truck, in a flexible waterproof container will float, thus it is possible to maintain the vehicle above the water level.

Accordingly, a need remains for a flotation safety device for vehicles in order to overcome the above-noted shortcomings. The present invention satisfies such a need by providing a flotation device that is easy to operate, is automatic in function, and provides peace of mind to concerned motorists. Instead of being trapped within a suddenly sinking automobile, the flotation device causes the car to float due to the buoyancy provided by the air bags. This stabilizes the vehicle, allowing any occupants to safely escape therefrom. The system thus prevents unnecessary loss of live and vehicular damage from occurring. In addition, the flotation device is hidden from a person's direct line of sight and is adaptable to a variety of different vehicles.

BRIEF SUMMARY OF THE INVENTION

In view of the foregoing background, it is therefore an object of the present invention to provide a flotation safety device for vehicles. These and other objects, features, and advantages of the invention are provided by an emergency flotation device for maintaining a vehicle at a buoyant state in a body of water.

The emergency flotation device includes a plurality of water-proof housings that are directly secured to a selected portion of the vehicle such that each housing is mounted medially under a plurality of tires of the vehicle. A plurality of selectively inflatable flotation bags are operably coupled directly to the housing. Such flotation bags may be coextensively shaped. The flotation bags are permanently conjoined directly to the housings respectively. Such flotation bags are deployable downwardly and outwardly wherein lateral portions of the flotation bags wrap beneath and around the tires such that a bottom half of the tires are completely encapsulated by the flotation bags respectively. The flotation bags preferably lay contiguously along an entire longitudinal length of the vehicle when the flotation bags are inflated to a maximum pressure. Each of the vehicle's tires receives one of the flotation bags thereabout during emergency conditions. Each flotation bag preferably has a medial portion directly abutted against an inner wall of the tires and extends medially towards a center of the vehicle.

A pneumatic mechanism is included for advantageously and effectively automatically inflating and deflating the flotation bags. Such a pneumatic mechanism is disposed within the housing and is spaced from the tires. The pneumatic mechanism preferably includes a plurality of air tanks that are nested within the housings and are isolated from ambient surroundings respectively. A plurality of flexible conduits have opposed end portions directly conjoined to the air tanks and a bottom surface of the housings respectively. Such conduits are completely disposed within the housings. A plurality of air-flow sensors are directly conjoined to the conduits respectively. Such air-flow sensors are seated downstream of the air tanks respectively. The conduits terminate within the housings and effectively discharge air into the flotation bags without extending out from the housings respectively.

A mechanism is included for sensing a water level directly engaged with the tires. Such a water level sensing mechanism is operably connected to the pneumatic mechanism for effectively instructing the pneumatic mechanism to inflate and deflate the flotation bags during emergency situations. The water level sensing mechanism may include a processor, a timer circuit electrically coupled to the processor, and a power supply source and a switch electrically coupled thereto. Such a switch further is electrically coupled to the processor and the timer circuit. At least one water sensor is electrically coupled to the processor. Such at least one water sensor generates and transmits a control signal embedded with a data stream that identifies a real time water level value around the tires.

A memory is electrically coupled to the processor. Such a memory includes software instructions that effectively cause the flotation device to detect whether the real time water level value has reached a predetermined water level threshold around the tires of the vehicle. The software instructions perform the steps of requesting an input signal defining the predetermined water level threshold value, extracting and isolating the data stream from the control signal, and generating and transmitting an inflation signal to the processor when the data stream value is greater than the predetermined water level threshold value. Further steps include generating and transmitting a deflation signal to the processor when the data stream value is less than the predetermined water level threshold value and generating and sending a timing signal to the timer circuit for toggling the switch to an open position and interrupting a power supply to the air tanks when the real time water level value oscillates above and below the predetermined water level threshold value.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
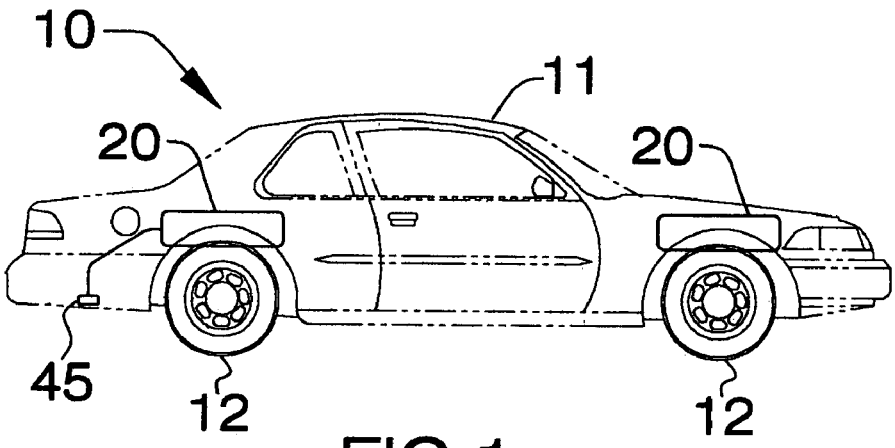
FIG. 1 is a side-elevational view showing a flotation safety device for vehicles, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-6 by the reference numeral 10 and is intended to provide a flotation safety device for vehicles. It should be understood that the device 10 may be used to provide flotation safety to many different types of modes of transport and should not be limited in use to only automobiles.

Figure 2:
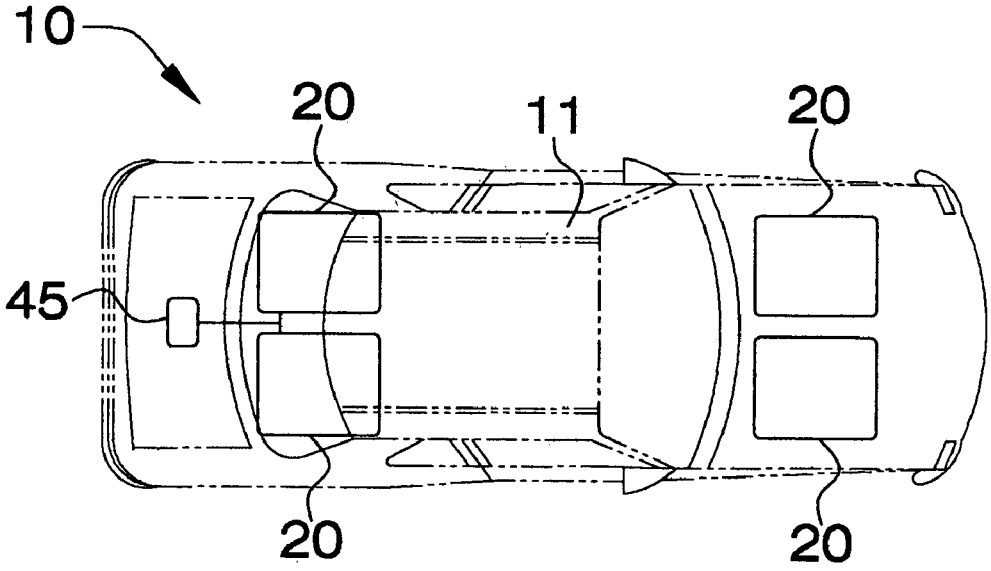
FIG. 2 is a top plan view of the device shown in FIG. 1.
Figure 3:
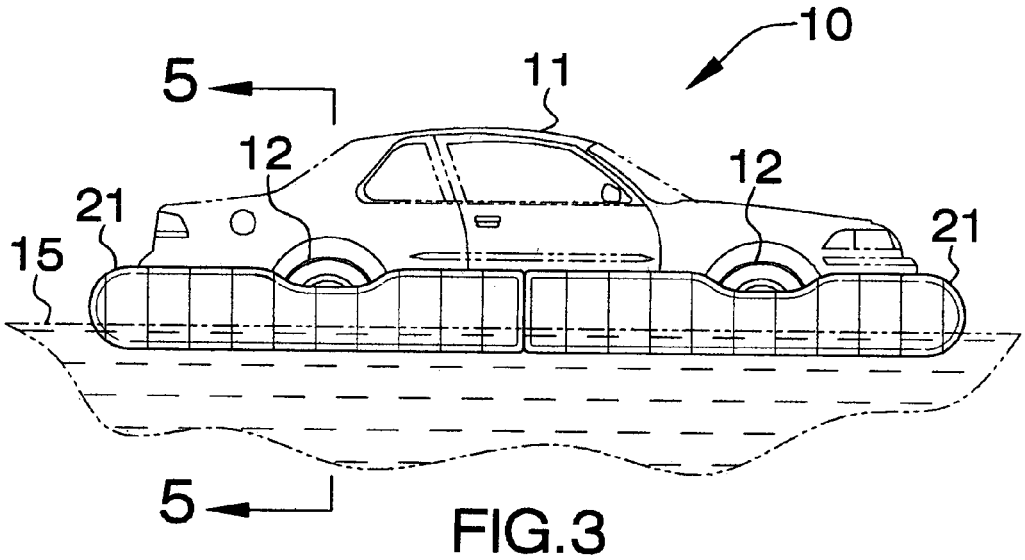
FIG. 3 is side-elevational view of the device shown in FIG. 1, showing the plurality of flotation bags during operating conditions.
Figure 4:
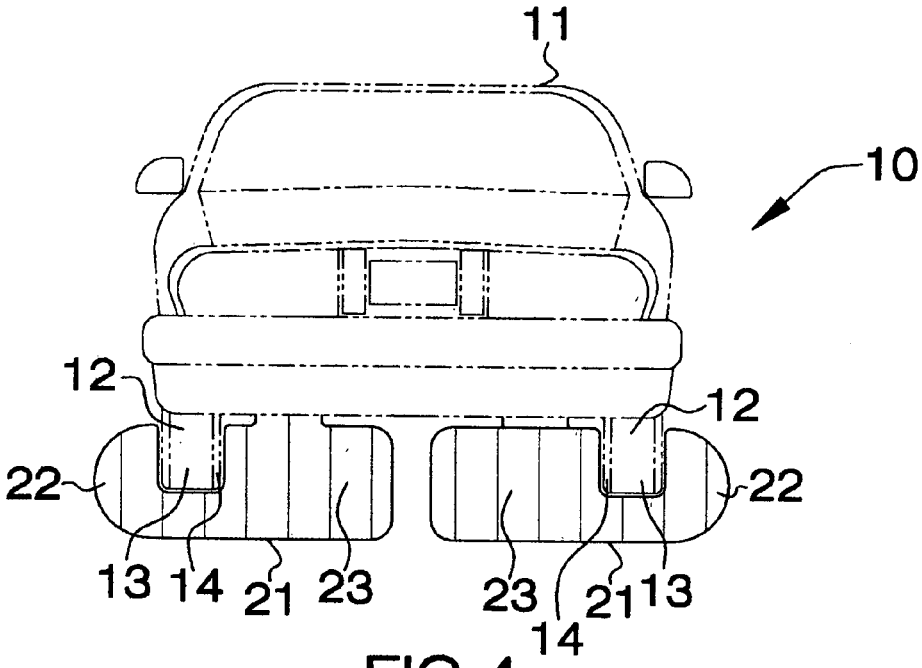
FIG. 4 is a rear-elevational view of the device shown in FIG. 3.
Figure 5:
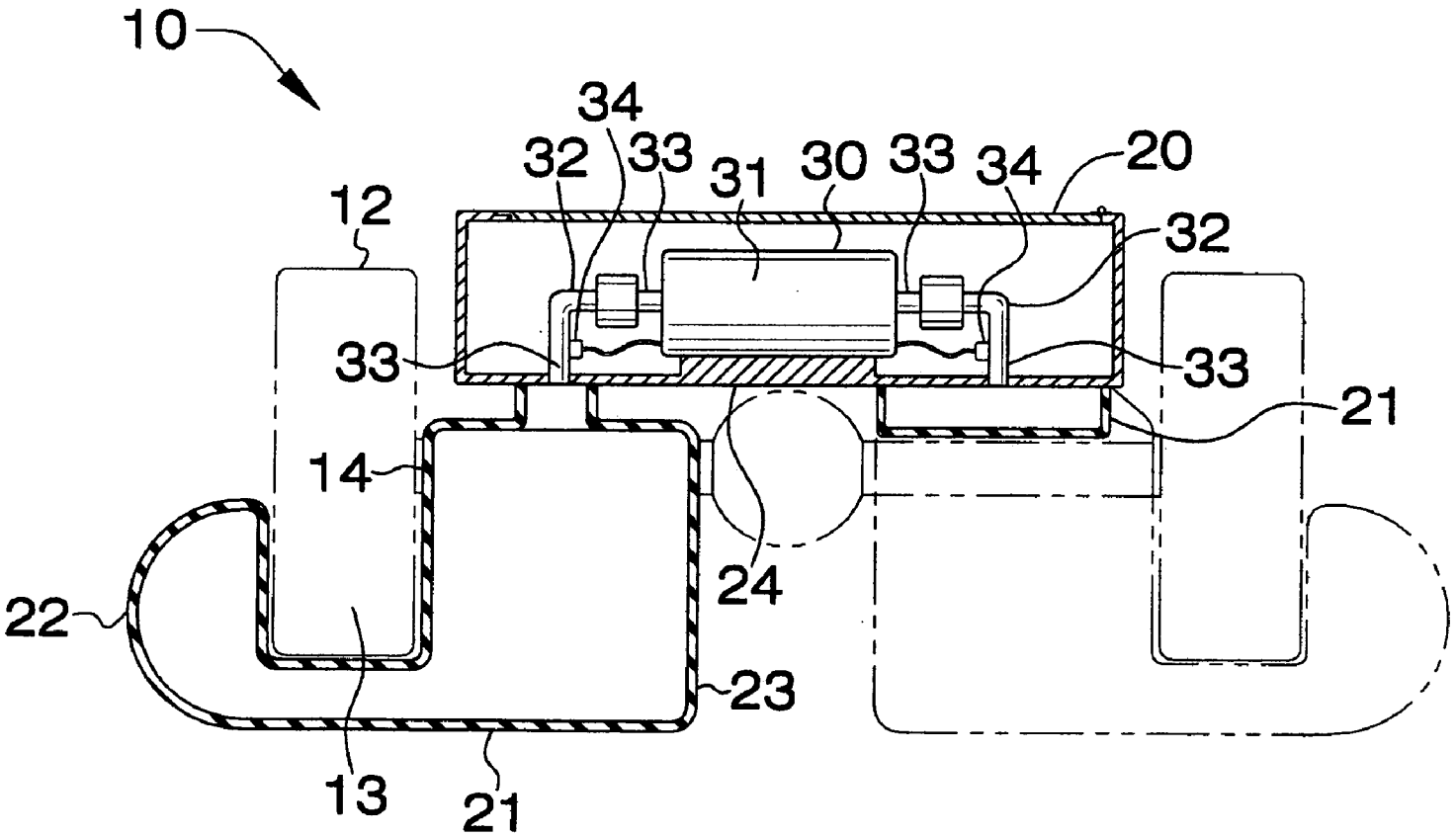
FIG. 5 is a cross-sectional view of the device shown in FIG. 1, taken along line 5-5.

Referring initially to FIGS. 1, 2 and 5, the device 10 includes a plurality of water-proof housings 20 that are directly secured, without the use of intervening elements, to a selected portion of the vehicle 11 such that each housing 20 is mounted medially under a plurality of tires 12 of the vehicle 11. Of course, the housings 20 may be mounted at any other suitable location on the vehicle 11, as is obvious to a person of ordinary skill in the art.

A plurality of selectively inflatable flotation bags 21 are operably coupled directly, without the use of intervening elements, to the housing 20. Such flotation bags 21 are coextensively shaped. Of course, the flotation bags 21 may be produced in a variety of different shapes, sizes and widths, depending on the required buoyant forces that must be created for a specific vehicle 11 to float, as is obvious to a person of ordinary skill in the art. The flotation bags 21 are permanently conjoined directly, without the use of intervening elements, to the housings 20 respectively.

Such flotation bags 21 are deployable downwardly and outwardly wherein lateral portions 22 of the flotation bags 21 wrap beneath and around the tires 12, which is essential such that a bottom half 13 of the tires 12 are completely encapsulated by the flotation bags 21 respectively. The flotation bags 21 lay contiguously along an entire longitudinal length of the vehicle 11 when the flotation bags 21 are inflated to a maximum pressure, which is a crucial for ensuring that the buoyant forces provided by the flotation bags 21 are evenly distributed along the vehicle 11 such that the. Each of the vehicle's tires 12 receives one of the flotation bags 21 thereabout during emergency conditions. Each flotation bag 21 has a medial portion 23 directly abutted, without the use of intervening elements, against an inner wall 14 of the tires 12 and extends medially towards a center of the vehicle 11.

Figure 6:
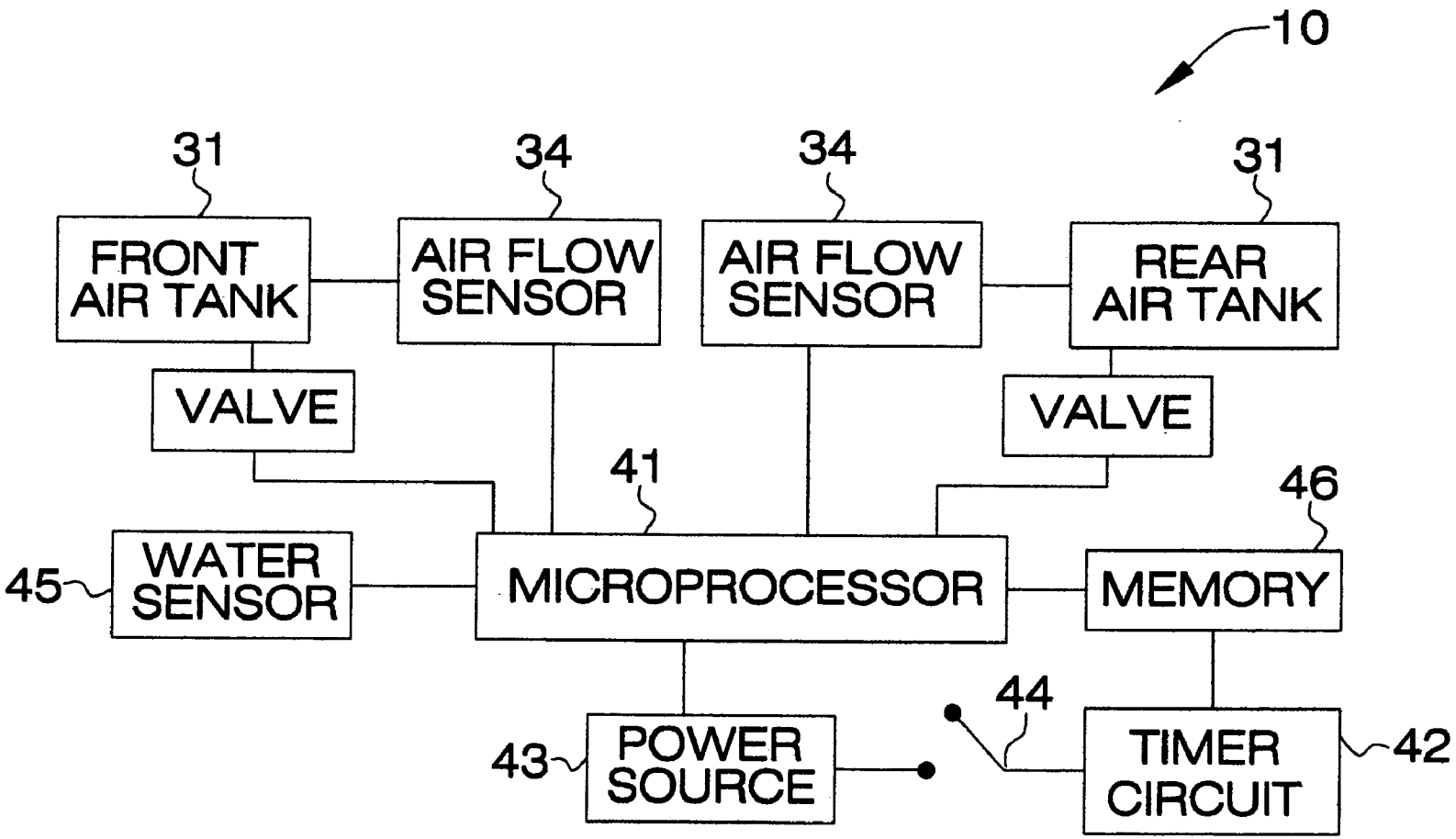
FIG. 6 is a schematic block diagram of the device shown in FIGS. 1 through 5.

Referring to FIGS. 5 and 6, a pneumatic mechanism 30 is included for advantageously and effectively automatically inflating and deflating the flotation bags 21. This is a crucial feature for ensuring that the device 10 is activated during an emergency situation where the occupant or occupants of the vehicle 11 may be unconscious due to the force of striking the water at high velocity, and are thus unable to manually activate the flotation device 10. Such a pneumatic mechanism 30 is disposed within the housing 20 and is spaced from the tires 12. The pneumatic mechanism 30 includes a plurality of air tanks 31 that are nested within the housings 20 and are isolated from ambient surroundings respectively.

A plurality of flexible conduits 32 have opposed end portions 33 directly conjoined, without the use of intervening elements, to the air tanks 31 and a bottom surface 24 of the housings 20 respectively. Such conduits 32 are completely disposed within the housings 20. A plurality of air-flow sensors 34 are directly conjoined, without the use of intervening elements, to the conduits 32 respectively. Such air-flow sensors 34 are seated downstream of the air tanks 31 respectively. The conduits 32 terminate within the housings 20 and effectively discharge air into the flotation bags 21 without extending out from the housings 20 respectively.

Referring to FIG. 6, a mechanism 40 is included for effectively sensing a water level 15 directly engaged with the tires 12. Such a water level sensing mechanism 40 is operably connected to the pneumatic mechanism 30, which is critical for effectively instructing the pneumatic mechanism 30 to inflate and deflate the flotation bags 21 during emergency situations. The water level sensing mechanism 40 includes a processor 41, a timer circuit 42 electrically coupled to the processor 41, and a power supply source 43 and a switch 44 electrically coupled thereto. Such a switch 44 further is electrically coupled to the processor 41 and the timer circuit 42. At least one water sensor 45 is electrically coupled to the processor 41. Such at least one water sensor 45 generates and transmits a control signal embedded with a data stream that identifies a real time water level value around the tires 12, which is a vital feature for detecting when the vehicle's tires 12 are submerged at an unacceptable water level 15.

Again referring to FIG. 6, a memory 46 is electrically coupled to the processor 41. Such a memory 46 includes software instructions that are vital for effectively causing the flotation device 10 to detect whether the real time water level value has reached a predetermined water level threshold around the tires 12 of the vehicle 11.

The software instructions perform the steps of requesting an input signal defining the predetermined water level threshold value, extracting and isolating the data stream from the control signal, and generating and transmitting an inflation signal to the processor 41 when the data stream value is greater than the predetermined water level threshold value. Further steps include generating and transmitting a deflation signal to the processor 41 when the data stream value is less than the predetermined water level threshold value and generating and sending a timing signal to the timer circuit 42 for toggling the switch 44 to an open position and interrupting a power supply to the air tanks 31 when the real time water level value oscillates above and below the predetermined water level threshold value.

Such steps are crucial to the proper operation of the inflation device 10 and advantageously ensure that the flotation bags 21 are only deployed when the vehicle 11 is at risk of being submerged in a body of water, and not during frequently occurring moist conditions like rain or driving through a puddle of water.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An emergency flotation device for maintaining a vehicle at a buoyant state in a body of water, said emergency flotation device comprising:

a plurality of water-proof housings directly secured to a selected portion of the vehicle such that said housing is mounted medially between a plurality of tires of the vehicle;

a plurality of selectively inflatable flotation bags operably coupled directly to said housing, said flotation bags being deployable downwardly and outwardly wherein lateral portions of said flotation bags wrap beneath and around the tires such that a bottom half of the tires are completely encapsulated by said flotation bags respectively;

pneumatic means for automatically inflating and deflating said flotation bags, said pneumatic means being disposed within said housing and spaced from the tires; and means for sensing a water level directly engaged with the tires, said water level sensing means being operably connected to said pneumatic means for instructing said pneumatic means to inflate and deflate the flotation bags during emergency situations.

2. The device of claim 1, wherein said pneumatic means comprises:

a plurality of air tanks nested within said housings and isolated from ambient surroundings respectively;

a plurality of flexible conduits having opposed end portions directly conjoined to said air tanks and a bottom surface of said housings respectively, said conduits being completely disposed within said housings; and a plurality of air-flow sensors directly conjoined to said conduits respectively, said air-flow sensors being seated downstream of said air tanks respectively;

wherein said conduits terminate within said housings and discharge air into said flotation bags without extending out from said housings respectively.

3. The device of claim 1, wherein said water level sensing means comprises:

a processor;

a timer circuit electrically coupled to said processor;

a power supply source and a switch electrically coupled thereto, said switch further being electrically coupled to said processor and said timer circuit;

at least one water sensor electrically coupled to said processor, said at least one water sensor generating and transmitting a control signal embedded with a data stream that identifies a real time water level value around the tires;

a memory electrically coupled to said processor, said memory including software instructions that cause said flotation device to detect whether the real time water level value has reached a predetermined water level threshold around the tires of the vehicle, said software instructions performing the steps of a. requesting an input signal defining the predetermined water level threshold value, b. extracting and isolating the data stream from said control signal, c. generating and transmitting an inflation signal to said processor when said data stream value is greater than said predetermined water level threshold value, d. generating and transmitting a deflation signal to said processor when said data stream value is less than said predetermined water level threshold value, and e. generating and sending a timing signal to said timer circuit for toggling said switch to an open position and interrupting a power supply to said air tanks when said real time water level value oscillates above and below said predetermined water level threshold value.

4. The device of claim 1, wherein said flotation bags lay contiguously along an entire longitudinal length of the vehicle when said flotation bags are inflated to a maximum pressure.

5. The device of claim 4, wherein each of said flotation bags has a medial portion directly abutted against an inner wall of the tires and extends medially towards a center of the vehicle.

6. An emergency flotation device for maintaining a vehicle at a buoyant state in a body of water, said emergency flotation device comprising:

a plurality of water-proof housings directly secured to a selected portion of the vehicle such that said housing is mounted medially between a plurality of tires of the vehicle;

a plurality of selectively inflatable flotation bags operably coupled directly to said housing, wherein said flotation bags are permanently conjoined directly to said housings respectively, said flotation bags being deployable downwardly and outwardly wherein lateral portions of said flotation bags wrap beneath and around the tires such that a bottom half of the tires are completely encapsulated by said flotation bags respectively;

pneumatic means for automatically inflating and deflating said flotation bags, said pneumatic means being disposed within said housing and spaced from the tires; and means for sensing a water level directly engaged with the tires, said water level sensing means being operably connected to said pneumatic means for instructing said pneumatic means to inflate and deflate the flotation bags during emergency situations.

7. The device of claim 6, wherein said pneumatic means comprises:

a plurality of air tanks nested within said housings and isolated from ambient surroundings respectively;

a plurality of flexible conduits having opposed end portions directly conjoined to said air tanks and a bottom surface of said housings respectively, said conduits being completely disposed within said housings; and a plurality of air-flow sensors directly conjoined to said conduits respectively, said air-flow sensors being seated downstream of said air tanks respectively;

wherein said conduits terminate within said housings and discharge air into said flotation bags without extending out from said housings respectively.

8. The device of claim 6, wherein said water level sensing means comprises:

a processor;

a timer circuit electrically coupled to said processor;

a power supply source and a switch electrically coupled thereto, said switch further being electrically coupled to said processor and said timer circuit;

at least one water sensor electrically coupled to said processor, said at least one water sensor generating and transmitting a control signal embedded with a data stream that identifies a real time water level value around the tires;

a memory electrically coupled to said processor, said memory including software instructions that cause said flotation device to detect whether the real time water level value has reached a predetermined water level threshold around the tires of the vehicle, said software instructions performing the steps of a. requesting an input signal defining the predetermined water level threshold value, b. extracting and isolating the data stream from said control signal, c. generating and transmitting an inflation signal to said processor when said data stream value is greater than said predetermined water level threshold value, d. generating and transmitting a deflation signal to said processor when said data stream value is less than said predetermined water level threshold value, and e. generating and sending a timing signal to said timer circuit for toggling said switch to an open position and interrupting a power supply to said air tanks when said real time water level value oscillates above and below said predetermined water level threshold value.

9. The device of claim 6, wherein said flotation bags lay contiguously along an entire longitudinal length of the vehicle when said flotation bags are inflated to a maximum pressure.

10. The device of claim 9, wherein each of said flotation bags has a medial portion directly abutted against an inner wall of the tires and extends medially towards a center of the vehicle.

11. An emergency flotation device for maintaining a vehicle at a buoyant state in a body of water, said emergency flotation device comprising:

a plurality of water-proof housings directly secured to a selected portion of the vehicle such that said housing is mounted medially between a plurality of tires of the vehicle;

a plurality of selectively inflatable flotation bags operably coupled directly to said housing, wherein said flotation bags are permanently conjoined directly to said housings respectively, said flotation bags being deployable downwardly and outwardly wherein lateral portions of said flotation bags wrap beneath and around the tires such that a bottom half of the tires are completely encapsulated by said flotation bags respectively, wherein each of the vehicle's tires receives one of said flotation bags thereabout during emergency conditions;

pneumatic means for automatically inflating and deflating said flotation bags, said pneumatic means being disposed within said housing and spaced from the tires; and means for sensing a water level directly engaged with the tires, said water level sensing means being operably connected to said pneumatic means for instructing said pneumatic means to inflate and deflate the flotation bags during emergency situations.

12. The device of claim 11, wherein said pneumatic means comprises:

a plurality of air tanks nested within said housings and isolated from ambient surroundings respectively;

a plurality of flexible conduits having opposed end portions directly conjoined to said air tanks and a bottom surface of said housings respectively, said conduits being completely disposed within said housings; and a plurality of air-flow sensors directly conjoined to said conduits respectively, said air-flow sensors being seated downstream of said air tanks respectively;

wherein said conduits terminate within said housings and discharge air into said flotation bags without extending out from said housings respectively.

13. The device of claim 11, wherein said water level sensing means comprises:

a processor;

a timer circuit electrically coupled to said processor;

a power supply source and a switch electrically coupled thereto, said switch further being electrically coupled to said processor and said timer circuit;

at least one water sensor electrically coupled to said processor, said at least one water sensor generating and transmitting a control signal embedded with a data stream that identifies a real time water level value around the tires;

a. memory electrically coupled to said processor, said memory including software instructions that cause said flotation device to detect whether the real time water level value has reached a predetermined water level threshold around the tires of the vehicle, said software instructions performing the steps of a. requesting an input signal defining the predetermined water level threshold value, b. extracting and isolating the data stream from said control signal, c. generating and transmitting an inflation signal to said processor when said data stream value is greater than said predetermined water level threshold value, d. generating and transmitting a deflation signal to said processor when said data stream value is less than said predetermined water level threshold value, and e. generating and sending a timing signal to said timer circuit for toggling said switch to an open position and interrupting a power supply to said air tanks when said real time water level value oscillates above and below said predetermined water level threshold value.

14. The device of claim 11, wherein said flotation bags lay contiguously along an entire longitudinal length of the vehicle when said flotation bags are inflated to a maximum pressure.

15. The device of claim 14, wherein each of said flotation bags has a medial portion directly abutted against an inner wall of the tires and extends medially towards a center of the vehicle.

* * * * *